United States Patent [19]

Vargo

[11] Patent Number: 4,553,725

[45] Date of Patent: Nov. 19, 1985

[54] STEEL SHELVING MOUNTING CLIP AND SHELVING STRUCTURE

[76] Inventor: William R. Vargo, 2101 Randall Ave., Lithonia, Ga. 30058

[21] Appl. No.: 523,070

[22] Filed: Aug. 15, 1983

Related U.S. Application Data

[63] Continuation-in-part of Ser. No. 352,116, Feb. 25, 1982, abandoned.

[51] Int. Cl.[4] ..... A47B 57/24

[52] U.S. Cl. ..... 248/221.3; 248/243; 248/250; 211/187

[58] Field of Search ..... 248/250, 220.7, 221.3, 248/73, 235, 243; 52/36; 108/109; 211/187, 135, 208, 90

[56] References Cited

U.S. PATENT DOCUMENTS

| | | | |
|---|---|---|---|
| Re. 27,186 | 10/1971 | Ferdinand et al. | 108/144 |
| Re. 27,200 | 10/1971 | Ferdinand et al. | 211/148 |
| 1,448,171 | 3/1923 | Waderlow . | |
| 2,144,602 | 1/1939 | Balmer | 248/223 |
| 2,528,910 | 11/1950 | Poe | 248/221.3 |
| 2,559,099 | 7/1951 | West | 248/221.3 |
| 2,803,352 | 8/1957 | Smola et al. | 211/147 |
| 2,896,794 | 7/1959 | Jarvis | 211/136 |
| 3,168,365 | 2/1965 | Evans | 108/109 |
| 3,295,902 | 1/1967 | Doult | 108/109 |
| 3,306,466 | 2/1967 | Liston | 248/243 |
| 3,522,920 | 8/1970 | Gray | 108/107 |
| 3,895,774 | 7/1975 | Sharp | 248/108 |
| 4,053,132 | 10/1977 | Del Pozzo | 292/76 |
| 4,101,108 | 7/1978 | Klein | 248/243 |
| 4,201,139 | 5/1980 | Suttles | 248/243 |

OTHER PUBLICATIONS

Clip Shelving—catalog page and photographs.

Two photographs of clips (disclosed in parent application) Catalog page describing use of clip shown in photograph.

*Primary Examiner*—Reinaldo P. Machado

*Assistant Examiner*—Alvin Chin-Shue

*Attorney, Agent, or Firm*—Body, Vickers & Daniels

[57] ABSTRACT

A steel shelving clip supports shelves by the bottom of the shelf flange, increasing the load carrying ability of the shelf. The clip has a support tab forming the bottom of a U-shaped slot which contains the vertical flange of a shelf. The clip also has a protuberance engaging an aperture in the shelf flange locking the shelf in the engaged position.

2 Claims, 4 Drawing Figures

STEEL SHELVING MOUNTING CLIP AND SHELVING STRUCTURE

This application is a continuation-in-part of my copending application Ser. No. 352,116 filed Feb. 25, 1982. Abandoned 3.28.84.

BACKGROUND OF THE INVENTION

This invention relates to metal shelving and more particularly to a metal shelving mounting clip for supporting shelving on conventional uprights or posts.

Metal shelving, specifically steel shelving, is used widely in industrial and commercial settings for storage and warehousing. Recently, steel shelving has also been appearing on the consumer market and finding use in home workshops and general storage. Steel shelving is strong, inexpensive and has a long life.

Better steel shelving is often sold as a shelving system. The user can purchase prefabricated posts or uprights, shelves, stiffeners, crossbraces, fasteners and other accessories designed to meet specific storage needs as required. Each of these components fit easily together in a multitude of configurations to provide the ultimate user with the means to design his own system to meet his own needs. The interchangeability and wide appeal of these systems allow manufacturers to mass produce very large numbers of standard individual components, thereby maintaining low cost.

Many systems produced by different manufacturers share common characteristics and interchangeable accessories for basic components.

One steel shelving system provides formed steel angle uprights or posts having apertures provided at specific intervals over the entire height of the post. Steel shelves are also provided having a horizontal shelf surface and downwardly extending flanges around the periphery of the horizontal surface. Mounting brackets are provided which have tabs engaging the apertures on the vertical posts, and a portion upward of the tabs in spaced relationship to the post providing a clearance for the flange, the upper end of the upward portion engaging the underside of the horizontal surface of the shelf. These mounting brackets are mounted on four posts which engage the under surface of the four corners of each shelf thereby forming a complete unit.

Difficulties have been experienced with shelving assemblies as described above. Shelves are now constructed of thinner, lighter gauge steel than in the past. The portion of the shelving clip which supports the underside of the shelf often dents the underside of the shelf when the shelf is heavily loaded. If loaded to extreme, the shelf can be pressed down sufficiently on the clip to cause a substantial deformation above the top of the clip. Further, the clip itself does not provide any means to lock the shelf to the post. A blow from underneath the shelf, such as can happen when loading a lower shelf, may free the shelf from the upright at one or more corners resulting in an unsafe condition.

The present invention contemplates a new and improved mounting bracket or clip which overcomes all the above referred to problems and provides for supporting a shelf by its vertical flange and locking the shelf in place on the post.

SUMMARY OF THE INVENTION

In accordance with the present invention, a clip for mounting a shelf on a post is provided with a lower segment having tabs engaging in apertures on an associated shelving post and an upper segment slightly offset from the lower segment and spaced from the post to accommodate the vertical flange of the shelf to be supported; and, means extending into the space defined by the upper segment and the post having a horizontal upper surface which is spaced from the upper extremity of the clip a distance less than the height of the shelf flange and which will support the bottom edge of the shelf flange.

Further, in accordance with the invention, the shelf support clip is provided with a protuberance positioned to engage a corresponding aperture in a shelf flange when the shelf is engaged to the clip, such protuberance being spring biased by the clip body itself into such aperture whereby the provision of a shelf supporting clip which will support a shelf on a vertical post mainly by engaging the shelf at the lower edge of its vertical flange and at least partly at the underside of the horizontal portion of the shelf.

Still another object of the present invention is the provision of a shelf supporting clip which will lock a shelf in its assembled position against a shelf support post.

The invention may take physical form in certain parts and arrangement of parts, a preferred embodiment of which will be described in detail in this specification and illustrated in the accompanying drawings which form a part hereof and wherein.

Figure 1:
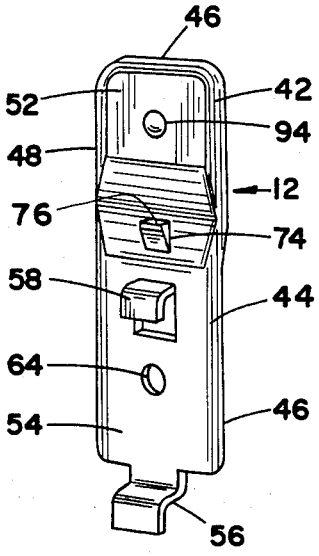
FIG. 1 is a perspective view of an unassembled shelving clip employed in the present invention.

Referring now to the drawings wherein the showings are for the purpose of illustrating the preferred embodiment of the invention only and not for the purpose of limiting same, the figures show a shelf mounting clip 12, a shelf 14 and an upright post 16. Shelf 14 is supported at each of its four corners on four separate posts 16 in a manner identical to the single corner shown. Additional shelves similar to shelf 14 will also be mounted above and below shelf 14 on posts 16 making a multi-shelf unit. Each shelf will be mounted in a manner identical to shelf 14. In addition, specialized supports, shelves and accessories can be fixed to the posts in a standarized manner.

Upright post 16 is formed of a single sheet of steel into two major components, a long leg 22 and a short leg 24, at right angles to one another. Long leg 22 has an interior segment 28, a central segment 30 and an outer segment 32. Interior segment 28 and outer segment 32 are coplanar with one another while central segment 30 is disposed inwardly of interior segment 28 and outer segment 32, inwardly meaning closer to shelf 14.

Circular apertures 34 are regularly spaced along the length of the outer segment 32 of long leg 22 and short leg 24. These apertures are used to attach stiffeners and shelving accessories. Central segment 30 is provided with square apertures 38 alternately in a regular pattern along its entire length.

As best seen in FIG. 1, clip 12 is divided into an upper segment 42 and lower segment 44, each having a channel-like cross-section with side flanges 46 and 48. The side flanges add rigidity to the planar portions 52 and 54 of clip upper segment and clip lower segment respectively. Clip lower segment 44 is provided with a lower tab 56 and an upper tab 58 which are spaced from one another the same distance as square apertures 36 on upright post 16. Clip 12 can be easily mounted on upright post 16 by simply inserting tabs 56 and 58 into two of square apertures 36 and lowering the clip so that the tabs engage the lower side 62 of apertures 36. Clip lower segment 44 is also provided with a circular aperture 64 which will be aligned with one of circular apertures 38 provided in post 16 when clip 12 is mounted on an upright post 16.

Figure 3:
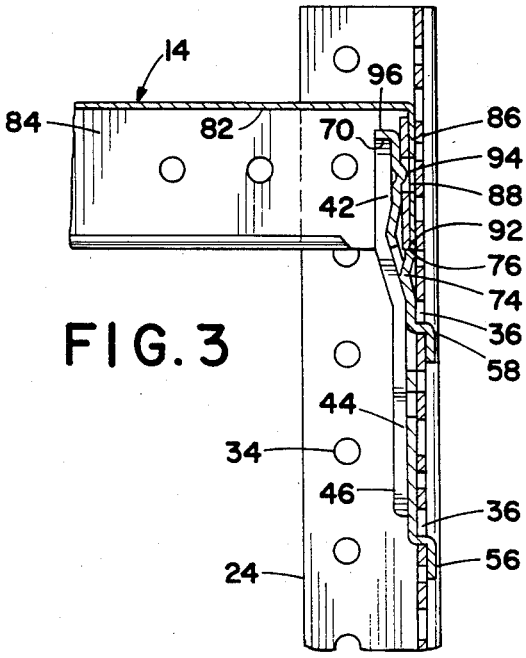
FIG. 3 is a cross-sectional view taken along line 3—3 of FIG. 2 showing the interaction of the clip, the shelf and the upright; and, FIG. 4 is an enlarged cross-sectional view similar to FIG. 3 showing a modified form of the clip interacting with a shelf and upright.

Clip upper segment planar portion 52 is not coplanar with clip lower segment planar portion 54. When the clip 12 is mounted on upright post 16, as shown in FIG. 3, lower segment planar portion is held against post 16 while there is a space between upper segment planar portion 52 and the facing portion of the central segment 30 of upright post 16. A support tab 74 is provided at the junction of clip upper segment 42 and clip lower segment 44. Support tab 74 is substantially coplanar with lower segment planar portion 54 and extends upwardly to an upper horizontal surface 76. Support tab 74 is held firmly against post central segment 30 by tabs 56 and 58 in square apertures 36. Support tab upper horizontal surface 76 provides a horizontal support surface bounded on one side by a central segment 30 of the upright post and on the other side by the planar portion 52 of upper clip segment 42. A U-shaped support slot is thereby provided bounded on three sides and having a horizontal support surface at its lower extremity for supporting shelf 14.

Shelf 14 is comprised of a horizontal portion 82 and vertical flanges 84. Vertical flanges 84 are lapped at each corner providing a flange segment 86 of double thickness. This double thickness flange segment 86 is spot-welded or bonded in some other means.

Double thick flange segment 86 is supported in the slot defined by post central segment 30, upper clip segment 42 and support tab upper surface 76. Lower edge 92 of double thick flange segment 86 is a substantial horizontal surface having a width dimension similar to the width dimension of support tab upper surface 76. Lower edge 92 rests upon support tab upper surface 76. All vertical loading on shelf 14 is transferred through vertical flange 84 to support tab upper surface 76 and transferred through the tabs 56, 58 to upright post 16. Shelf loads are transferred to the post as close to the post as possible thereby minimizing torque on the post 16 and clip 12.

In the embodiment described hereinabove, the moderate spacing provided between top flange 96 of clip 12 and shelf horizontal portion 82 (best seen in FIG. 3) insures that all vertical loading on the shelf will be transferred through vertical flange 84 to upper horizontal surface 76 on support tab 74. This spacing thus prevents clip top flange 96 from deforming horizontal shelf portion 82 if the shelf is of a thin-gauge and/or an excessive load is placed on the shelf. As will be appreciated, however, even a shelf made of light-gauge steel, or sheet metal, is capable of withstanding some loading.

Figure 2:
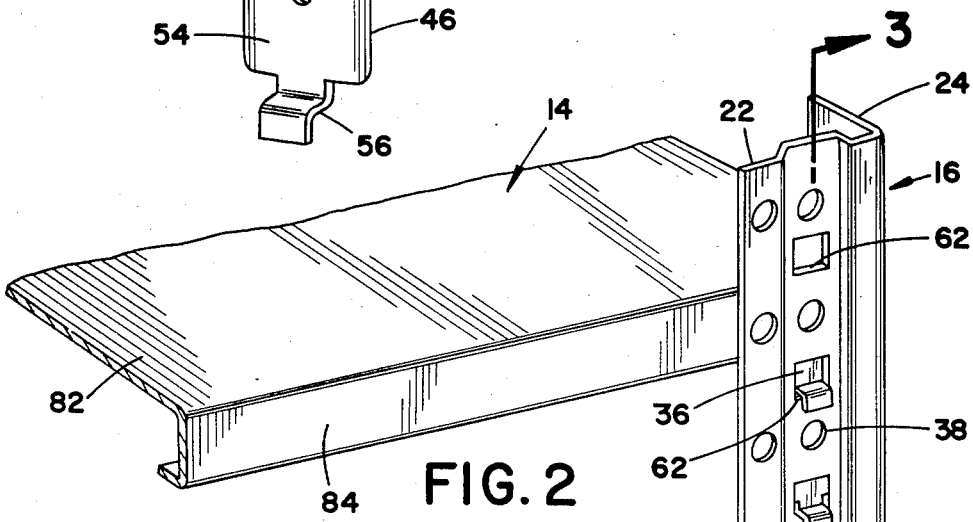
FIG. 2 is a perspective view of a corner of a shelf mounted on a shelving upright with the clip shown in FIG. 1.
Figure 4:
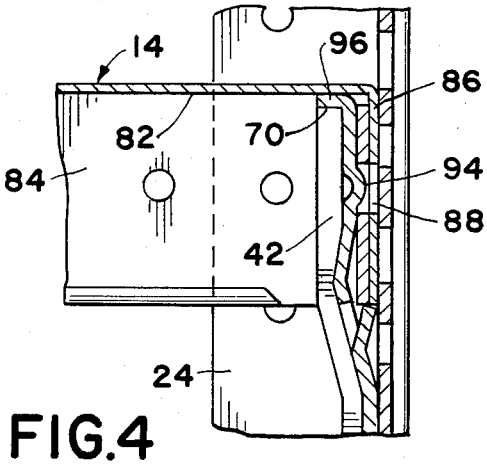

Therefore, in a modification of the embodiment shown in FIGS. 1–3, upper clip segment 42 is formed of a somewhat longer length, as best seen in FIG. 4, such that the spacing between clip top flange portion 96 and shelf horizontal portion 82 is substantially reduced to where the spacing is negligible, and the two portions are almost touching. A spacing of a few thousandths of an inch would provide a clip wherein vertical shelf flange 84 alone would normally abut and bear against clip surface 76.

Shelf portion 82 should deflect slightly, or if an increased or excessive load on the shelf were to cause yielding deformation of either flange 84 or support tab 74, shelf horizontal portion 82 would begin to rest on clip top flange 96. In such situations, clip top flange 96 would gradually bear a portion of the total load exerted on the clip. Thus, a second horizontal supporting surface is provided on the clip to bear a portion of the weight of the shelf.

The spacing between clip top flange 96 and shelf horizontal portion 84 necessary to effect such a two-surface loading on the clip will, of course, be a function of several factors such as the thickness and strength of the shelf, the strength of the clip, and the dimensions of support tab 74. Preferably, the spacing would be such that at all times and under all loading conditions, at least fifty percent of the load on clip 12 is borne by horizontal support surface 76. It will be appreciated that the magnitude of the spacing between clip top flange 96 and shelf horizontal portion 82 will be extremely small, and that such a dimension cannot be visually depicted in the drawing (FIG. 4). Though FIG. 4 appears to show clip top flange 96 touching or engaging shelf horizontal portion 82, the illustration in FIG. 4 is intended to depict an extremely small, almost negligible spacing between clip top flange 96 and the shelf horizontal portion, which spacing will close upon the loading of the shelf and provide a second load bearing surface on the uppermost extremity of the clip.

Double thick flange segment 86 is also provided with an aperture 88 which aligns with clip central protuberance 94. Central protuberance 94 is spring biased into aperture 88 by the clip 12 thereby securely locking the shelf 14 in its mounted position. The spring biasing by the clip also holds clip upper segment planar portion 52 close to post central segment 30, preventing any motion or misalignment of double thick flange segment 86. This assures adequate bearing area engagement between support tab upper surface 76 and lower edge 92 of double thick flange segment 86.

Under all but the most extreme loads, deformation of the double thick flange segment 86 is prevented. The shelf horizontal portion 82 will not be dented and the loading of shelf 14 will be transferred to upright post 16 as close to upright post 16 as possible, minimizing torque and strengthening the entire assembly. Because torque is minimized and loads are transferred as close to the load carrying members as possible, the chances of failure due to bending of clip 14 are reduced and a more secure assembly provided.

A single clip interacting with a single shelf corner and upright post is shown. Of course, shelf 14 will be supported at its four corners on four posts in an identical manner to that shown. Additionally, the larger shelving assemblies, different kinds of posts, such as beaded posts for mounting shelves on two sides, shelf reinforcing and sway braces can be provided. Shelves, drawer inserts, ledges, door assemblies and other accessories can be mounted on uprights similar to or identical to upright 16 with shelf mounting clip 12.

The invention has been described with reference to the preferred embodiment and a modification thereof. Obviously, other modifications and alterations will occur to those skilled in the art on reading and understanding of this specification. It is my intention to include all such modifications and alterations insofar as they come within the scope of the appended claims or the equivalence thereof.

Having thus described the invention, it is claimed:

1. In a support assembly including an upstanding post having spaced apertures along the length thereof, and a shelf having an upper support surface, an underside, and a flange of predetermined length and thickness having apertures therethrough, said flange extending from the periphery of said shelf adjacent said underside thereof and having a lower edge:

a mounting clip comprised of a channel-shaped body portion having an upper segment and a lower segment, said segments being generally planar, with said upper segments being laterally offset from said lower segment such that said upper segment is approximately parallel to said lower segment;

at least one tab extending from said lower segment through the apertures in said post to interlock said clip with said post and define a generally U-shaped slot between said upper segment and said post wherein said slot is slightly less than the thickness of said flange;

a protuberance on said upper segment extending toward said post wherein said protuberance engages said aperture in said flange to lock said shelf in place; and a flat support tab defining the bottom of said U-shaped slot for engaging and supporting the lower edge of said flange when said flange is within said slot, said support tab disposed substantially in the same vertical plane as said lower segment and being located such that a space exists between said clip and the underside of said shelf.

2. The improvement of claim 1, wherein said space between the said upper segment of said clip and the underside of said shelves is negligible such that said upper segment engages the underside of said shelves when an appreciable load is exerted thereon, said upper segment supporting not more than fifty percent of the said load on said clip at any time.

* * * * *